US008695769B2

(12) United States Patent
Morszeck

(10) Patent No.: US 8,695,769 B2
(45) Date of Patent: Apr. 15, 2014

(54) PIECE OF LUGGAGE WITH ZIPPER

(75) Inventor: Dieter Morszeck, Cologne (DE)

(73) Assignee: Rimowa GmbH (DE)

( * ) Notice: Subject to any disclaimer, the term of this patent is extended or adjusted under 35 U.S.C. 154(b) by 509 days.

(21) Appl. No.: 12/528,514

(22) PCT Filed: Feb. 27, 2008

(86) PCT No.: PCT/EP2008/052357

§ 371 (c)(1),
(2), (4) Date: Oct. 1, 2009

(87) PCT Pub. No.: WO2008/104558

PCT Pub. Date: Sep. 4, 2008

(65) Prior Publication Data

US 2010/0320047 A1 Dec. 23, 2010

(30) Foreign Application Priority Data

Feb. 27, 2007 (DE) ..... 20 2007 002 966 U

(51) Int. Cl.
*A45C 13/10* (2006.01)

(52) U.S. Cl.
USPC ..... 190/123; 190/119; 190/903; 206/810; 383/97

(58) Field of Classification Search
USPC ..... 190/119, 122, 123, 903, 111, 112, 121, 190/127; 383/97; 206/812, 810; 220/260, 220/200
See application file for complete search history.

(56) References Cited

U.S. PATENT DOCUMENTS

| | | | | | |
|---|---|---|---|---|---|
| 2,218,666 | A | * | 10/1940 | Tamoschat | 150/119 |
| 2,716,473 | A | * | 8/1955 | Droutman | 190/119 |
| 3,084,771 | A | * | 4/1963 | Davis | 190/113 |
| 3,158,238 | A | * | 11/1964 | Kish, Jr. | 206/315.9 |
| 3,298,479 | A | * | 1/1967 | Palmer et al. | 190/109 |
| 3,468,274 | A | * | 9/1969 | Koffler | 112/475.08 |
| 3,477,553 | A | * | 11/1969 | Kish, Jr | 190/119 |
| 3,513,951 | A | * | 5/1970 | Leong et al. | 190/115 |
| 3,780,838 | A | * | 12/1973 | Slan | 190/121 |
| 4,083,089 | A | * | 4/1978 | Minami | 24/381 |
| 5,044,476 | A | * | 9/1991 | Seynhaeve | 190/18 A |
| 5,111,919 | A | * | 5/1992 | Hamatani et al. | 190/109 |
| 5,310,031 | A | * | 5/1994 | Plath | 190/18 A |
| 5,813,094 | A | * | 9/1998 | Perez, II | 24/381 |
| 6,062,356 | A | * | 5/2000 | Nykoluk | 190/18 R |
| 6,345,709 | B1 | * | 2/2002 | Cheng | 190/119 |
| 6,493,909 | B2 | * | 12/2002 | Paul | 24/381 |
| 7,143,878 | B2 | * | 12/2006 | Selvi | 190/103 |

FOREIGN PATENT DOCUMENTS

| | | | |
|---|---|---|---|
| GB | 2366512 | A | 3/2002 |
| GB | 2372981 | A | 9/2002 |
| JP | 03029604 | A | 2/1991 |
| JP | 2002325616 | A | 11/2002 |
| WO | WO 9008631 | A1 * | 8/1990 |

* cited by examiner

*Primary Examiner* — Sue A Weaver
(74) *Attorney, Agent, or Firm* — Waddey & Patterson, P.C.; Lucian Wayne Beavers

(57) ABSTRACT

In a piece of luggage, particularly a suitcase (1), comprising luggage parts which are connected to each other via a zipper (10), it is provided that the piece of luggage has a frame element (6), and that the frame element (6) on at least one outer edge extending along the frame element (6) has a receiving profile (28) for an edge profile (22) of a zipper (10) or of a suitcase shell (28).

13 Claims, 4 Drawing Sheets

PIECE OF LUGGAGE WITH ZIPPER

BACKGROUND OF THE INVENTION

1. Field of the Invention

The present invention relates to a piece of luggage, particularly a suitcase, comprising luggage parts which are connected to each other via a zipper.

2. Description of the Prior Art

A suitcase of the above type is known from WO 2004/095971 A1.

Such pieces of luggage whose luggage parts, particularly shell elements, are connected to each other by a zipper, have the advantage that the luggage parts can be sewn to the zipper. A disadvantage resides in that a sewing attachment to hard frame parts is not possible.

SUMMARY OF THE INVENTION

Thus, it is an object of the invention to provide a piece of luggage of the initially mentioned type wherein also rigid, particularly luggage parts can be connected to each other or to textile luggage parts or to luggage parts of plastic by means of a zipper.

According to the invention, for achieving the above object, it is provided that the piece of luggage comprises a frame element and that said frame element on at least one outer edge extending along the frame element comprises a receiving profile for an edge profile of a zipper or a suitcase shell. This receiving profile offers the advantage that e.g. a zipper or, by way of alternative, the surrounding edge of a suitcase shell, can be inserted by an edge profile thereof into the receiving profile. It is also possible, during production of the piece of luggage, to press the receiving profile tightly into place after insertion of the edge profile of the zipper or the suitcase shell into the profile, so that, due to the resultant reduction of the gap size of the receiving profile, the connection is highly resistant against tearing open.

Preferably, it is provided that the edge profile with respect to its cross-sectional shape is adapted to the receiving profile and is fastened to a first side portion of the zipper, while the second side portion of the zipper is fastened to a luggage part. The second side portion can also be attached in a conventional manner to another luggage part, e.g. a textile part or a shell element.

According to a preferred embodiment, it is provided that the edge profile is fastened, particularly by sewing, to the longitudinal edge of a side portion of the zipper.

By way of alternative, it can be provided that the edge profile is formed integrally with a side portion of the zipper and is arranged on the free edge of the zipper.

According to a further variant of the invention, it is provided that the edge profile consists of the teeth or of a plastic spiral of a toothing of a zipper. The use of the teeth or a plastic spiral of a zipper as an edge profile has the advantage that the edge profile can be produced in a simple and inexpensive manner and has a resistance to tearing open which corresponds to that of the usual toothing of a zipper.

Advantageously, it can be provided that the side portions of a first zipper are connected to the side portion of a separated second zipper component, and that the teeth or a plastic spiral of said second zipper component engage the receiving profile in the manner of an edge profile. Such a solution allows for very low expenses in production.

Preferably, the frame element forms a closed frame of the piece of luggage. This leads to a high stability of the piece of luggage without the penalty of abandoning the advantages of a textile piece of luggage or a piece of luggage consisting of suitcase shells.

According to one embodiment, it is provided that the zipper (10) on the side facing away from the frame element (6) is connected to a luggage part consisting of a shell element. The shell element herein can be a suitcase shell made of plastic, it being preferred that the shell element consists of a polycarbonate sheet.

According to a further embodiment, it can be provided that the shell element is a suitcase shell made of plastic.

It is also possible to provide two frame elements, the zipper being arranged between said two frame elements.

According to a further embodiment, it is provided that the frame element is provided with the receiving profile only at one end side and on the side facing away from the receiving profile is connected to a suitcase shell, preferably integrally. The frame element can be rigid and preferably consist of metal.

According to a further variant of the invention, it is provided that the zipper on the edge facing away from the receiving profile is connected, by means of a welt, to a luggage part, particularly a shell element. In this case, the welt can be integrally connected to the side portion of the zipper.

An embodiment of the invention will be described in greater detail hereunder with reference to the drawings.

DETAILED DESCRIPTION

Figure 1:
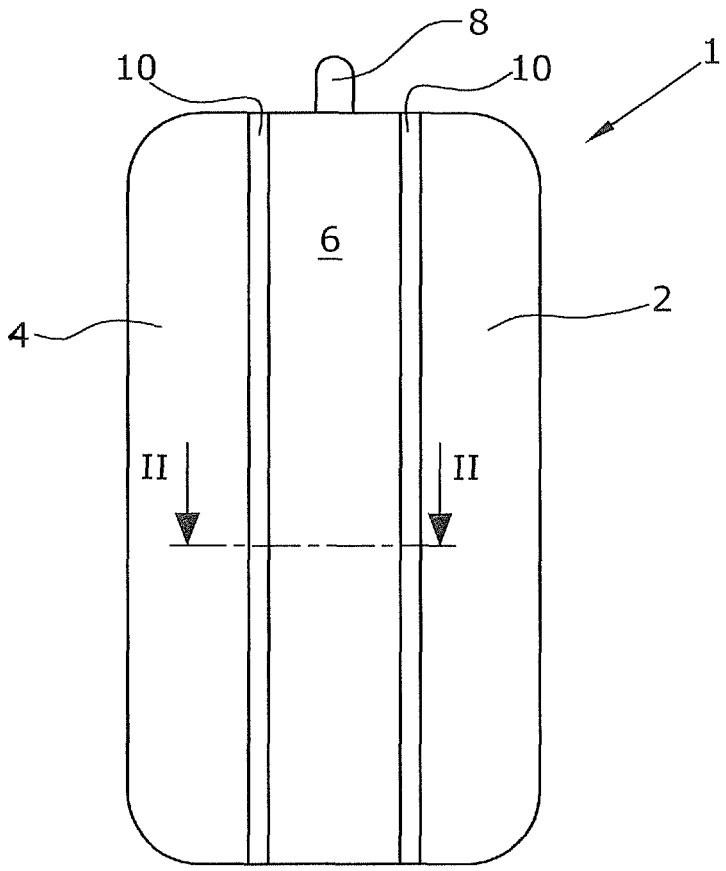
FIG. 1 is a view of a piece of luggage comprising a frame element according to the invention and two suitcase shells.

FIG. 1 illustrates a suitcase 1 comprising two suitcase shells 2,4 which can be articulated to each other at the bottom of the suitcase. Provided on the edge of said suitcase shells 2,4 is a closure device in the form of a zipper 10 which together with welt bands 26 is sewn to the edges of suitcase shells 2,4.

The suitcase shells 2,4 are preferably made of plastic, e.g. of a polycarbonate sheet having a thickness of about 1 to 2 mm.

Of course, also shell elements or luggage parts made of textile material can be sewn to the zipper 10 or the welt band 26, or only to a side portion 16,18 of zipper 10.

The suitcase 1 shown in FIG. 1 comprises a centrally arranged frame element 6 which preferably forms a closed frame.

Figure 2:
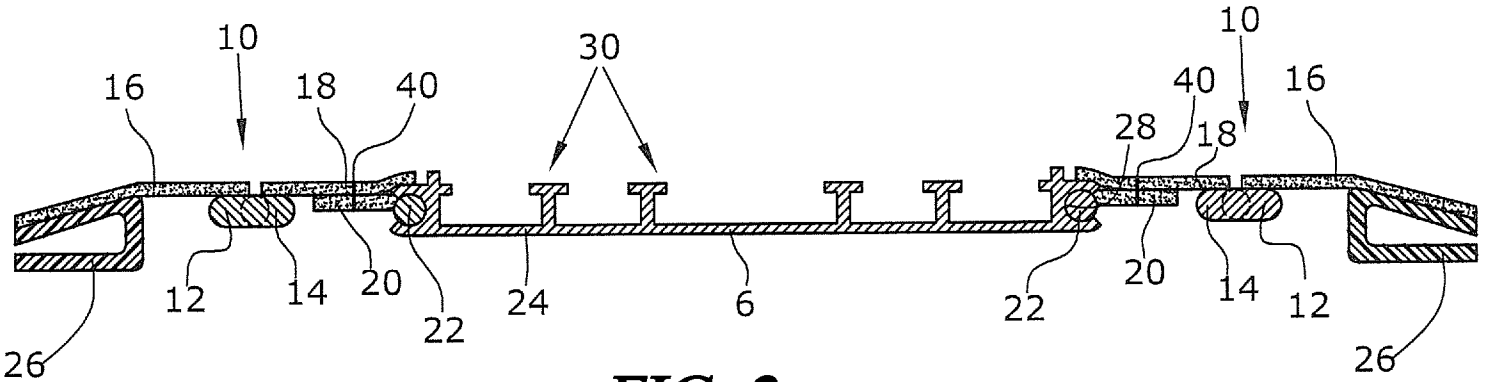
FIG. 2 is a sectional view taken along line II-II in FIG. 1.
Figure 3:
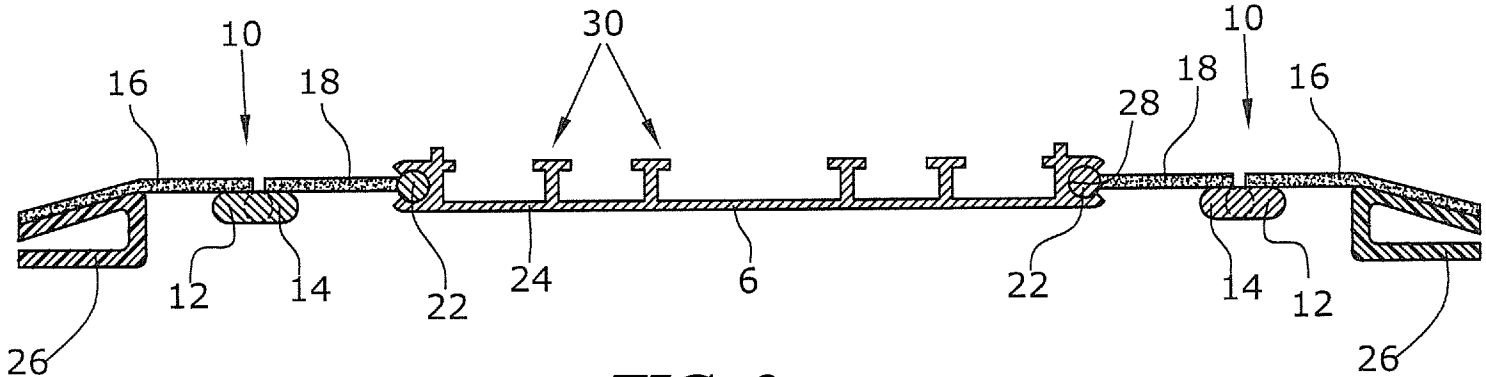
FIG. 3 is a schematic illustration similar to FIG. 2 showing zippers having integral edge profiles.
Figure 4:
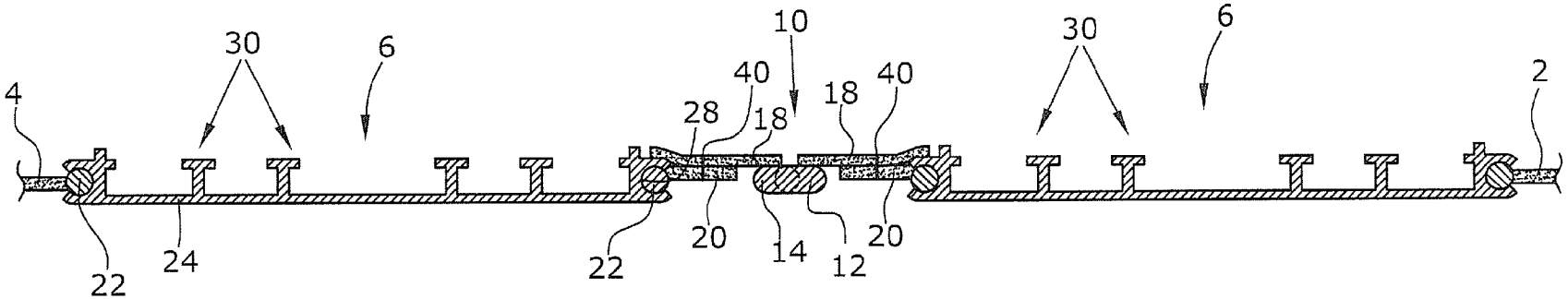
FIG. 4 is a schematic illustration showing two frame elements connected by a zipper.
Figure 5:
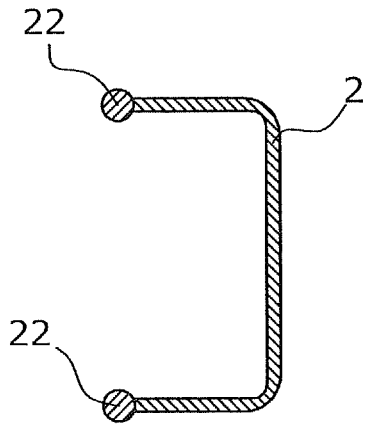
FIG. 5 is a schematic illustration showing an edge profile as a surrounding edge of a shell.
Figure 6:
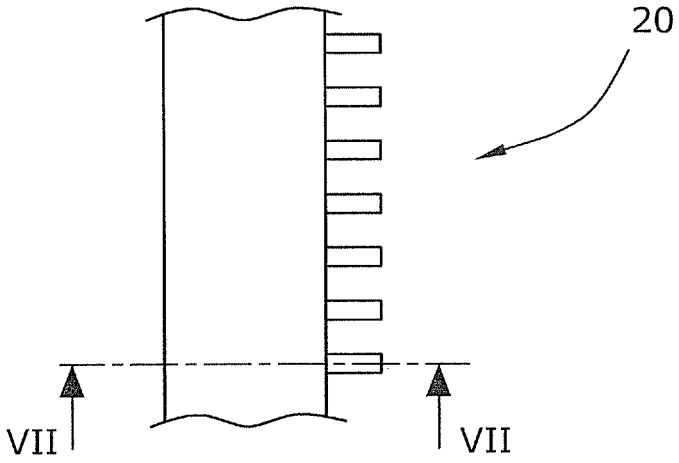
FIG. 6 is a schematic illustration of an edge profile including teeth.
Figure 7:
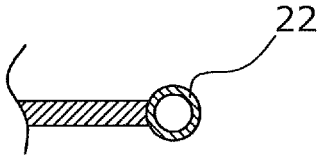
FIG. 7 is a section view along line VII-VII of FIG. 6 schematically showing the edge profile including teeth.

Frame element 6 consists e.g. of a continuously cast metal profile wherein, on one or both sides, the outer edges of said metal profile, particularly on the end side, are formed with a receiving profile 28 for an edge profile 22 of the zipper 10 or of a suitcase shell 2,4. In FIG. 2, the receiving profile 28 is illustrated as having a circular cross-sectional shape. It goes without saying, however, that also other suitable cross-sectional shapes are possible which serve to increase the resistance to tearing of the zipper or of the surrounding edge of a suitcase shell 2,4. For instance, the outer edges of the receiving profile can leave a smaller opening, or their gap size can be made narrower by a pressure application process subsequent to the insertion of the edge profile 22 or of the surrounding edge of a suitcase shell 2,4 so that the edge profile 22 and respectively the surrounding edge of the suitcase shell will be tightly clamped into place.

The frame element 6 preferably consists of an aluminum profile. On the inner side of the suitcase, webs 30 can extend from frame element 6, allowing for attachment of e.g. lining elements on the inner side.

Of course, the frame element can also be given a larger or smaller width than shown in FIG. 1, and the frame element 6 can also be formed integrally with a shell element made of metal or plastic.

Zipper 10 comprises two side portions 16,18 which on their inner side edges are provided with a toothing, particularly in the form of plastic spirals 12,14 which in the closed state of zipper 10 will be hooked into each other. On its outer side, side portion 16 is provided with a welt band 26 adapted to receive e.g. the surrounding edge of a suitcase shell, wherein side portion 16 together with welt band 26 can be sewn to the surrounding edge of the suitcase shell 2,4 made of plastic. Instead of the suitcase shell, also a shell element or a luggage part made of textile material can be sewn to zipper 10.

As can be seen in FIG. 2, side portion 18 is connected to a separated second zipper component, preferably by sewing 40 or bonding. The side portion 20 of said separated second zipper component comprises a plastic spiral 22 engaging the receiving profile 28.

Such a side portion 20 of a second zipper component can also be arranged on the opposite side on side portion 16 so that, in principle, it is also possible to use the zipper 10 for connecting two frame elements 6 to each other. In this case, these frame elements 6 can also form the frame of a suitcase shell made of metal, wherein the surrounding edge of the metallic suitcase shell can be conventionally riveted to frame element 6 or be clamped into place in a receiving profile 28.

The invention claimed is:

1. A piece of luggage, comprising:

a frame element including first and second outer edges extending along the frame element, the first and second outer edges including first and second receiving profiles, respectively; and first and second luggage parts including first and second edge profiles received in the first and second receiving profiles, respectively;

said first and second luggage parts including first and second suitcase shells, respectively, and at least the first luggage part including a first zipper, the first zipper being attached to the first edge profile, and the first edge profile being clamped into place within the first receiving profile so that the first edge profile is fixedly attached to the frame element; and wherein the first zipper includes a first side portion and a second side portion, the first side portion of the first zipper being attached to the first edge profile, and the second side portion of the first zipper being fastened to the first suitcase shell.

2. The piece of luggage according to claim 1, wherein the first side portion of the first zipper is fastened to the first edge profile by sewing.

3. The piece of luggage according to claim 1, wherein the first edge profile is formed integrally with the first side portion of the first zipper and is arranged on a free edge of the first side portion of the first zipper.

4. The piece of luggage according to claim 1, wherein at least one of the edge profiles comprises teeth of a separated zipper component.

5. The piece of luggage according to claim 4, wherein:

the separated zipper component is connected to one of the side portions of the first zipper; and wherein the teeth comprising the edge profile are defined on the separated zipper component and are engaged in the first receiving profile.

6. The piece of luggage according to claim 1, wherein the frame element forms a closed frame of the piece of luggage.

7. The piece of luggage according to claim 1, wherein the second edge profile comprises a surrounding edge of the second suitcase shell.

8. The piece of luggage according to claim 1, wherein the suitcase shells are made of plastic.

9. The piece of luggage according to claim 1, wherein the suitcase shells each comprise a polycarbonate sheet.

10. The piece of luggage according to claim 1, wherein the frame element is a rigid frame element made of metal.

11. The piece of luggage according to claim 1, wherein:

the first zipper includes a welt band attached to the first suitcase shell.

12. The piece of luggage according to claim 11, wherein the welt band is integrally fastened to a side portion of the first zipper.

13. A piece of luggage, comprising:

a frame element including first and second outer edges extending along the frame element, the first and second outer edges including first and second receiving profiles, respectively; and first and second luggage parts including first and second edge profiles received in the first and second receiving profiles, respectively;

said first and second luggage parts including first and second suitcase shells, respectively, and at least the first luggage part including a first zipper;

wherein at least one of the edge profiles comprises teeth of a separated zipper component and wherein the teeth comprise a plastic spiral.

* * * * *

UNITED STATES PATENT AND TRADEMARK OFFICE

CERTIFICATE OF CORRECTION

PATENT NO. : 8,695,769 B2
APPLICATION NO. : 12/528514
DATED : April 15, 2014
INVENTOR(S) : Dieter Morszeck It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 621 days.

Signed and Sealed this
Twenty-ninth Day of September, 2015

Michelle K. Lee

Michelle K. Lee
*Director of the United States Patent and Trademark Office*